US010159882B2

(12) United States Patent
Ruth

(10) Patent No.: US 10,159,882 B2
(45) Date of Patent: Dec. 25, 2018

(54) SWING AND THROW TRAINING TOOL

(71) Applicant: Daniel Gary Ruth, Greenwich, CT (US)

(72) Inventor: Daniel Gary Ruth, Greenwich, CT (US)

( * ) Notice: Subject to any disclaimer, the term of this patent is extended or adjusted under 35 U.S.C. 154(b) by 1074 days.

(21) Appl. No.: 14/513,632

(22) Filed: Oct. 14, 2014

(65) Prior Publication Data

US 2015/0217172 A1 Aug. 6, 2015

Related U.S. Application Data

(63) Continuation-in-part of application No. 14/172,271, filed on Feb. 4, 2014, now abandoned.

(51) Int. Cl.

| | |
|---|---|
| ***A63B 69/00*** | (2006.01) |
| ***A63B 69/38*** | (2006.01) |
| ***A63B 69/36*** | (2006.01) |
| ***A63B 71/06*** | (2006.01) |
| ***A63B 24/00*** | (2006.01) |
| *A63B 102/32* | (2015.01) |
| *A63B 102/02* | (2015.01) |
| *A63B 21/00* | (2006.01) |

(Continued)

(52) U.S. Cl.

CPC ..... *A63B 69/00* (2013.01); *A63B 24/0003* (2013.01); *A63B 69/0002* (2013.01); *A63B 69/002* (2013.01); *A63B 69/3608* (2013.01); *A63B 69/38* (2013.01); *A63B 71/0622* (2013.01); *A63B 21/4015* (2015.10); *A63B 2069/0006* (2013.01); *A63B 2069/0008* (2013.01); *A63B 2071/0625* (2013.01); *A63B 2071/0627* (2013.01); *A63B 2102/02* (2015.10); *A63B 2102/14* (2015.10); *A63B 2102/18* (2015.10); *A63B 2102/32* (2015.10); *A63B 2207/02* (2013.01); *A63B 2209/08* (2013.01); *A63B 2209/10* (2013.01); *A63B 2210/50* (2013.01); *A63B 2220/40* (2013.01); *A63B 2220/44* (2013.01); *A63B 2220/803* (2013.01); *A63B 2220/836* (2013.01); *A63B 2225/50* (2013.01)

(58) Field of Classification Search

CPC ... A63B 69/00; A63B 69/0002; A63B 69/002; A63B 69/3608; A63B 69/38; A63B 24/0003; A63B 71/0622

See application file for complete search history.

(56) References Cited

U.S. PATENT DOCUMENTS

| | | | | |
|---|---|---|---|---|
| 5,704,856 A | | 1/1998 | Morse | |
| 5,984,796 A | * | 11/1999 | Mah | A63B 69/3608 473/215 |
| 6,800,035 B1 | * | 10/2004 | Couch | A63B 69/3608 473/213 |

* cited by examiner

*Primary Examiner* — James Hull

(74) *Attorney, Agent, or Firm* — Ohlandt, Greeley, Ruggiero & Perle, L.L.P.

(57) ABSTRACT

A device is provided that has an arcuate guide disposed about a shoe. The guide has a start point on an inner side of the shoe, an intermediate point on a heel side of the shoe, and an end point on an outer side of the shoe. The guide is angled upward across the heel side from the inner side to the outer side with the angle in a range between 30 degrees to 60 degrees. The start point and end point are positioned on the shoe at a point lower than the intermediate point. An indicator is moveable along the guide. The indicator is an alert that the user has executed proper body motions during a swing or throw, when the indicator traverses from the start point through the intermediate point to the end point.

7 Claims, 16 Drawing Sheets

(51) Int. Cl.
*A63B 102/14* (2015.01)
*A63B 102/18* (2015.01)

SWING AND THROW TRAINING TOOL

CROSS REFERENCE TO RELATED APPLICATIONS

This application is a continuation in part of application Ser. No. 14/172,271 filed Feb. 4, 2014, the entire contents of which are incorporated by reference herein.

BACKGROUND

1. Field of the Disclosure

The present disclosure is related to a tool or apparatus for teaching and training those who play golf, baseball, tennis, football, lacrosse, and the like, proper swinging motions and proper throwing motions by indicating that the athlete or user has used proper form and technique. More particularly, the present disclosure pertains to a wearable device that indicates to a user that the user has properly pushed off with their rear foot during a swing or throw, and properly rotated through the swing or throw until the rear foot reaches a proper finishing position. This corresponds to proper swinging or throwing motions involving the user's entire body.

2. Description of Related Art

One common motion is critical to a correct swing or throwing motion across multiple sporting disciplines such as golf, tennis, football, baseball, and lacrosse. Beginning and amateur users rarely execute this action properly.

Currently, users in golf, tennis, lacrosse, football, and baseball rely on professional lessons, specialized facilities, video analysis, and various swing devices in an attempt to learn the proper motions in these respective sports.

Most of these swinging devices are specific to one sport and focus on individual components of the swing. Those devices that address the entire swing or throwing motion in a specific sport do so at points in the motion's sequence that won't always ensure the proper execution. Also, to be most effective, these tools often require that a user's swing already has a sufficient foundation to benefit from minor adjustments and refinement.

Certain devices measure hip rotation. The disadvantages of such devices are that a user will attempt to control the swing by rotating his or her hips. However, controlling the motion with the hips may introduce other swing errors and won't necessarily produce a correct swing motion since the hips should follow and be pulled in a swing sequence that starts by pushing off with the back foot.

Certain devices are wrist worn. Such a device indicates to a user how to manipulate his hands and hand motions, but this won't always produce the correct swing motion, since the hands are the last body part in the swing and are pulled through as part of the correct downswing motion that starts with the back foot push off.

There is a continuing need for a method or device that doesn't require cumbersome straps. Such devices often require the user to connect with a strap, for example, a front leg to a front arm. Although this does assist a player with weight shift, it may not assist rotation. Further, such strapped devices and may be awkward when performing anything but stationary practice and may not be practical during a competition or dynamic practice session.

Accordingly, it is desirable to have an easily accessible training tool that focuses on the specific action or motion critical to a swing. Further, it is even more desirable to have such a tool that can also be utilized without modification for other sports.

SUMMARY

The present disclosure provides an inexpensive, easy to use, portable, live training tool that urges a user to focus on the specific action of pushing off of the back foot when initiating a downswing or throw and not letting up the push and follow through until the back foot is in the vertical position.

The present disclosure provides a tool or device for training a user to build a swinging and throwing motion foundation which is both portable and functional across multiple sporting disciplines.

A tool according to the present disclosure teaches the proper body actions and movement with which to provide a solid swing foundation across various sports and to equip users with a fundamental knowledge of swinging and throwing mechanics.

A device is provided. The device has an arcuate guide disposed about a shoe. The guide has a start point on an inner side of the shoe, an intermediate point on a heel side of the shoe, and an end point on an outer side of the shoe. The guide is angled upward across the heel side from the inner side to the outer side with the angle in a range between about 30 degrees to about 60 degrees. The start point and end point are positioned on the shoe at a point lower than the intermediate point. The device also has an indicator moveable along the guide. The indicator is an alert to the user of the device that the user of the device has executed proper body motions during a swing or throw, when the indicator traverses from the start point through the intermediate point to the end point. The indicator can be a first metal sphere. The guide can be a tubular member that houses the indicator. The device can further include a shoe attachment connecting the guide to the shoe. The shoe attachment can be, for example, hook and loop strips, magnets, and alternatively adhesives. A complete traversal of the guide from the start point to the end point by the indicator alerts the user that the user has pushed off with a rear foot from a flat position on a surface, kept an inside of a front foot anchored to the surface; and shifted the rear foot to a vertical position once the swing or throw is completed.

A digital device is also provided. The digital device includes an accelerometer, a motion sensor, a non-transitory storage medium, and a micro-processing unit. The micro-processing unit is communicatively coupled to the accelerometer, motion sensor, and non-transitory storage medium. The micro-processing unit is configured to detect that a path traveled by a user's heel corresponds to proper body motions and techniques when the user performs a swing or throw. The micro-processing unit is also configured to store data pertaining to the swing or throw in the non-transitory storage medium. The digital device is attachable to a heel side of a shoe or can be embedded within the shoe. The digital device can also have a compass and a gyroscope, each communicatively coupled to the micro-processing unit. The digital device can also have a battery and charging circuit electrically connected to the accelerometer, motion sensor, and micro-processing unit. Further, the digital device can have a radio communicatively coupled to the micro-processing unit. The radio is also communicatively coupled to a user interface device for viewing data stored in the non-transitory storage medium. Yet further, the digital device can have an indicator communicatively coupled to the micro-processing unit. The indicator can include an audible alert or visual feedback. The indicator alerts the user that the user has pushed off with a rear foot from a flat position on a surface, kept an inside of a front foot anchored to the surface; and shifted the rear foot to a vertical position once the swing or throw is completed.

A method is provided that includes the steps of detecting that a user has pushed off with a rear foot from a flat position on a surface at a start of a swing or throw, detecting that the rear foot has moved to a vertical position once the swing or throw is completed, and alerting the user that the swing or throw has been executed utilizing proper body motions and technique. The method can also include detecting that the user has kept an inside of a front foot anchored to the surface and/or determining that an indicator has moved along a guide from a starting point through an intermediate point to an ending point. The starting point of the guide is located on an inner side of a shoe corresponding to the rear foot. The intermediate point of the guide is located about a heel side of the shoe. The ending point of the guide is on an outer side of the shoe, with the starting point and ending point being situated lower on the shoe than the intermediate point. The method can also include determining that an elapsed time from the detecting that the user has pushed off with the rear foot from the flat position on the surface to the detecting that the rear foot has moved to a vertical position is about 0.15 to about 0.25 seconds.

An assembly is also provided. The assembly includes a shoe, an arcuate guide, and an indicator. The shoe has an inner side, a heel side, and an outer side. The arcuate guide is disposed about the shoe. The guide has a start point on the inner side of the shoe, an intermediate point on the heel side of the shoe, and an end point on the outer side of the shoe. The guide is angled upward across the heel side from the inner side to the outer side in a range between about 30 degrees to about 60 degrees. The start point and end point are positioned lower on the shoe than the intermediate point. The indicator moveable along the guide. The indicator is an alert to the user that the user has executed proper body motions during a swing or throw, when the indicator traverses from the start point through the intermediate point to the end point.

DETAILED DESCRIPTION OF THE PREFERRED EMBODIMENT

Figure 1:
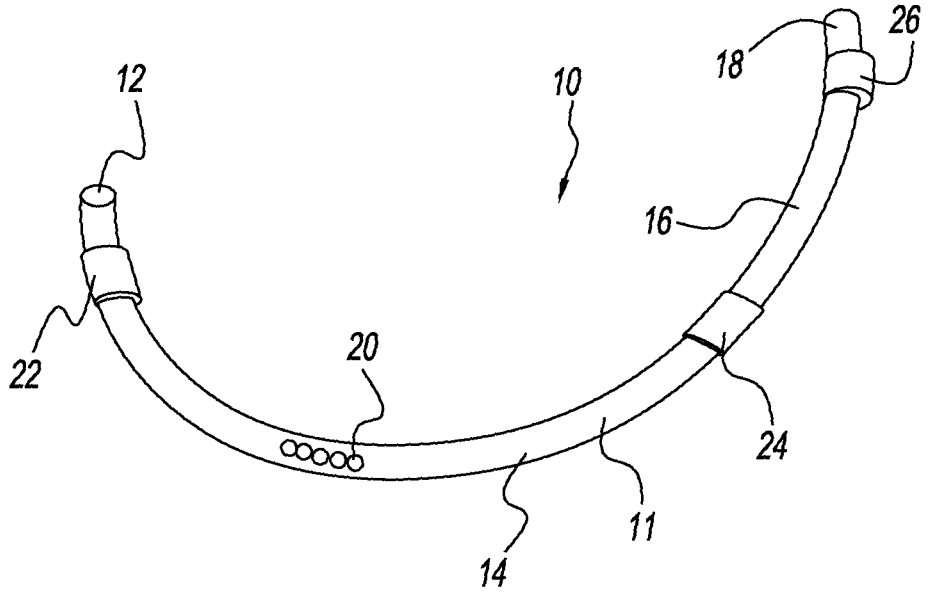
FIG. 1 is a view of the device according to the present disclosure.
Figure 2:
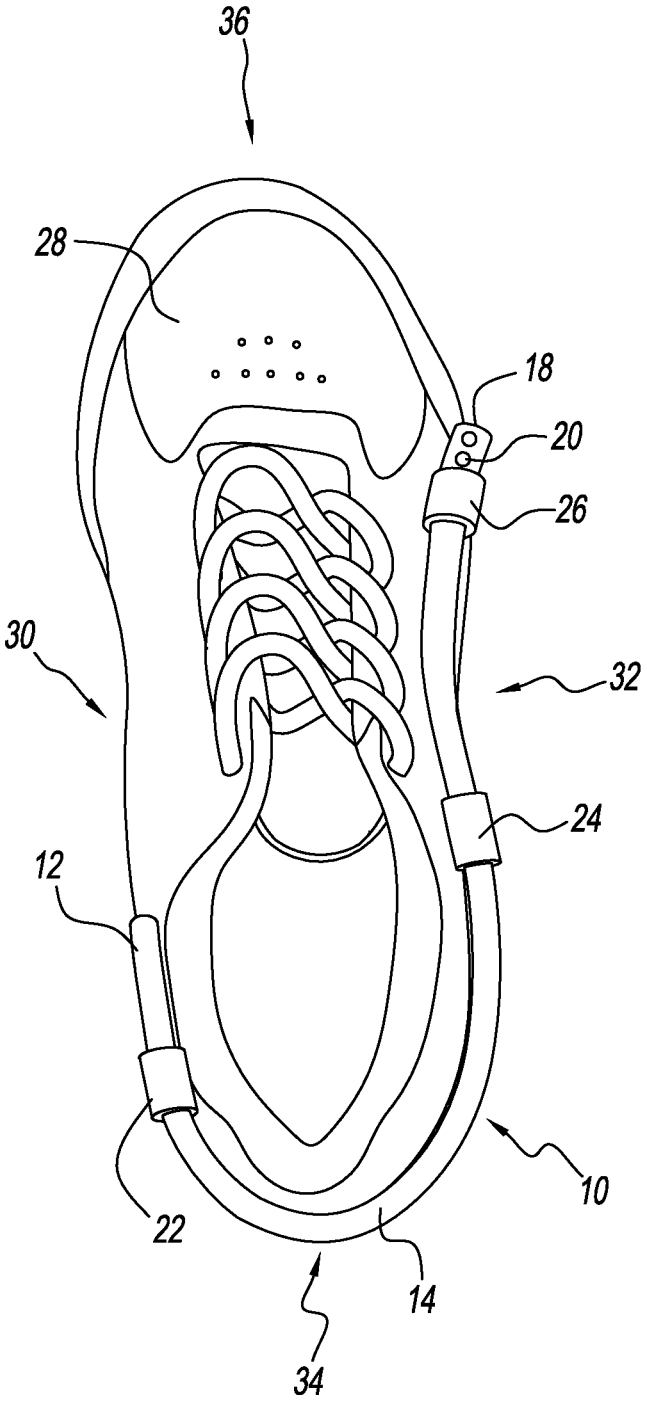
FIG. 2 is a top down view of the device of FIG. 1 on a shoe.
Figure 3:
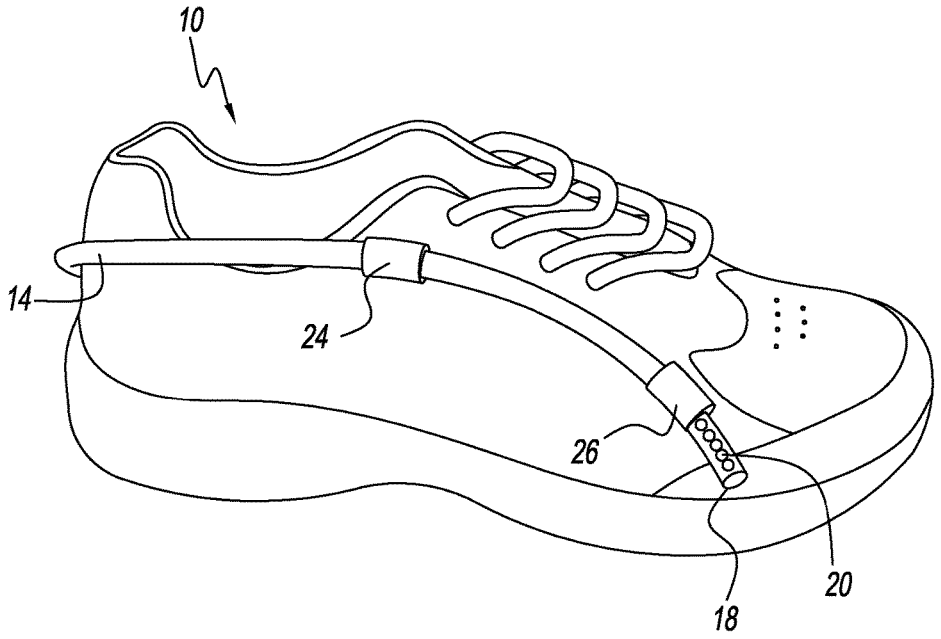
FIG. 3 is perspective view of the device of FIG. 1 on a shoe.
Figure 4:
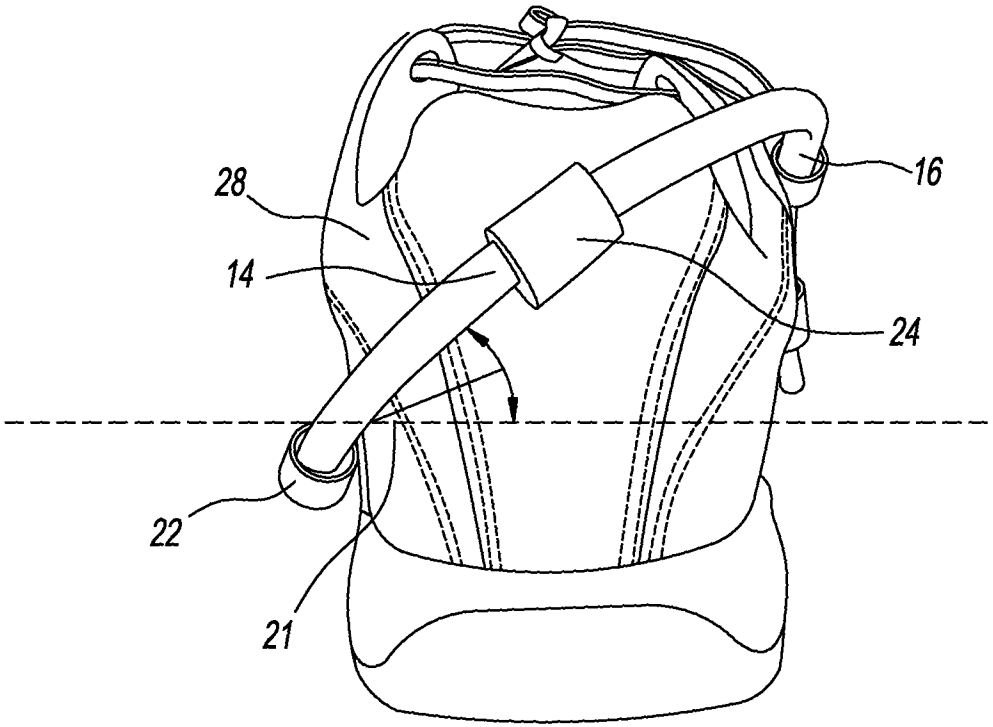
FIG. 4 is rear view of the device of FIG. 1 on a shoe.
Figure 5:
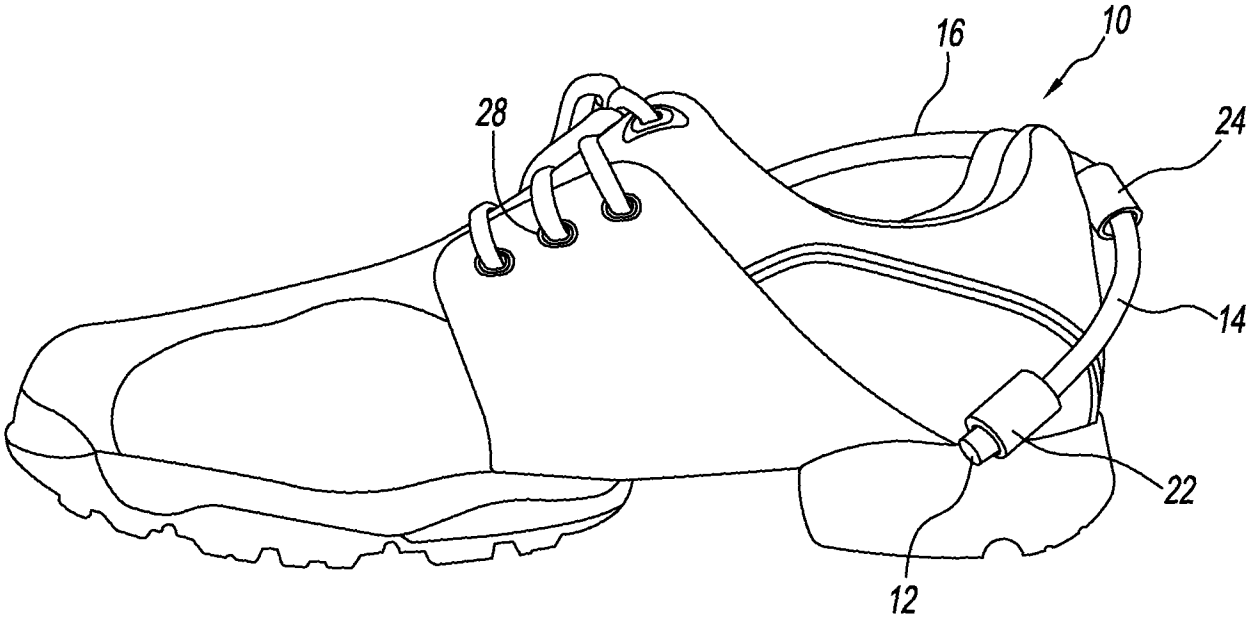
FIG. 5 is a side view of the device of FIG. 1 on a shoe.

Referring to the drawings and in particular to FIG. 1, there is shown a swing and throw training tool 10 (hereinafter "device 10"), according to the present disclosure.

Device 10 has a tubular shaped member 11 having a proximal end 12, heel section 14, side section 16, and distal end 18. Within member 11 is at least one indicator 20 for alerting the user of whether the swinging or throwing motion of user is proper.

A guide or path along which indicator 20 can move is defined by the length of member 11. Thus, the guide or path begins at proximal end 12, such that, in use, indicator 20 starts at proximal end 12. A user is alerted as to proper body motions when indicator 20 travels from a starting position at proximal end 12 to an ending position at distal end 18. Thus, device 10 indicates to a user that the user has properly pushed off on their rear foot during a swing or throw and properly rotated through the swing or throw until the rear foot reaches a proper finishing position. This corresponds to proper swinging or throwing motions involving the user's entire body.

As shown in FIGS. 2, 3, 4, and 5, device 10 is attachable to a shoe and should be worn on a user's rear foot, or push off foot. The shoe has an inner side 30, outer side 32, heel side 34, and front side 36. Heel section 14 of device 10 should wrap around heel side 34 with side section 16 being disposed on outer side 32 such that distal end 18 extends toward front side 36. Proximal end 12 should be located on inner side 30.

Device 10 can attach to a shoe 28 at three attachment points, 22, 24, and 26. Attachment point 22 fixes proximal end 12 on inner side 30. Attachment point 24 secures heel section 14 around heel side 34 such that an arc is formed in member 11 around the user's heel. Attachment point 26 secures distal end 18 towards the front of outer side 32.

Proximal end 12 is located between about 3 to 4 inches from heel side 34. Heel section 14 should be located such that at least a portion thereof is located higher on the shoe than proximal end 12.

An angle 21 (see FIG. 4) of member 11 on shoe 28 at heel section 14 is between about 30 to 60 degrees, preferably between about 40 to 50 degrees and most preferably 45 degrees.

The length of member 11 on the outer side 32 can be between about 2 and 10 inches, but must be longer than the rise of member 11 from proximal end 12 to heel section 14.

Distal end 18 should be located near the sole of shoe 28. This prevents indicator 20 from getting stuck at heel section 14 and returning to proximal end 12 when a user executes the proper push off and body motions.

In one embodiment, device 10 is constructed with clear vinyl tubing serving as member 11. Alternatively, member 11 can be opaque vinyl tubing, a hose, a pipe, or a molded formation. Member 11 should be flexible enough to form an arc around a user's heel. Alternatively, if member 11 is rigid, it should be shaped such that an arc is formed around a user's heel. Member 11 can be made of a plastic, metal, fiberglass, ceramic, a polymer material that can be molded, and the like.

Member 11 is about 5 to 12 inches long, and more preferably, 6 to 8 inches long. The diameter of member 11 is between about ⅛ and ½ inch in diameter, preferably ¼ inch.

Indicator 20 can be a spherical metal or plastic ball. For example, indicator 20 can a ball bearing, a bead, a BB, and the like, including multiples thereof. In certain embodiments indicator 20 can also be a liquid.

Preferably, indicator 20 is between two and seven, more preferably between two and five, and most preferably three metallic spheres.

Indicator 20 should be sized less than an inner diameter of member 11, such that indicator 20 has a free range of motion within member 11 and along the path defined therein.

Proximal end 12 and distal end 18 can be closed off with a sealant. The sealant can be clear caulk, a rubber stopper, or any other sphere/plug having a diameter larger than the inner diameter of member 11.

Attachment of device 10 to a shoe is accomplished by hook and loop strips, magnets, adhesives, and the like, as well as any combinations thereof.

Figure 6:
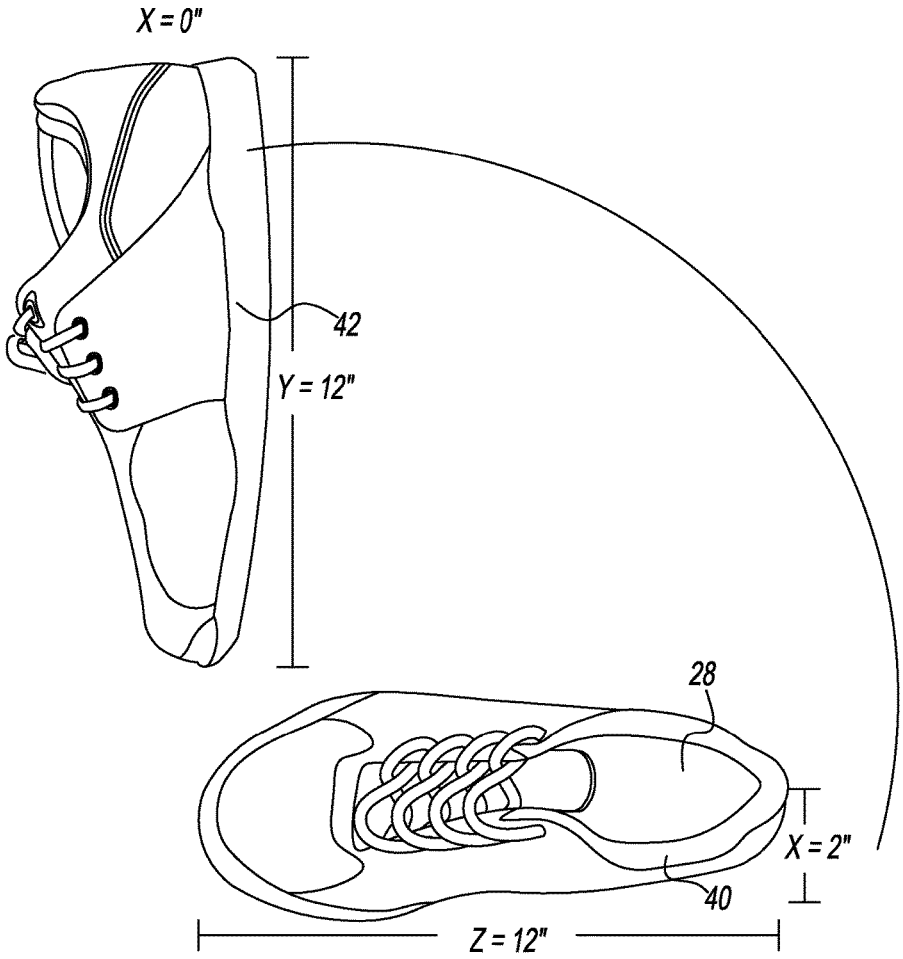
FIG. 6 is a view of the path the device of FIG. 1 detects when a swing or throw is proper.
Figure 7:
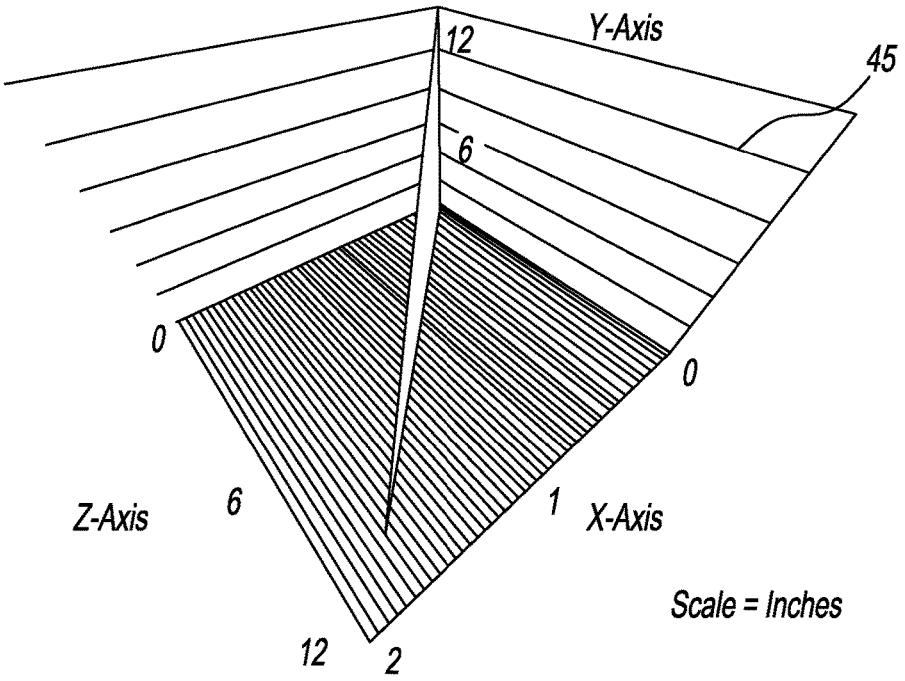
FIG. 7 is a Cartesian coordinate system illustrating the path of FIG. 6.

Referring now to FIGS. 6 and 7, there is shown an illustration of the path which device 10 detects when a user initiates and completes a proper throwing or swinging motion with his body. The initial position is a push off start position 40 and the final position is a push off end position 42. The path is shown with reference to Cartesian coordinate system 45. "X" represents a distance from heel center to a foot rotation center. "Y" represents a distance from a heel center to a foot rotation center. "Z" represents a distance form a heel center to a foot rotation center. In the example, the shoe is 12 inches long. However, the shoe can be any size and thus the length would change accordingly. For example if the shoe were 10 inches, then both Y and Z would be 10.

Figure 8:
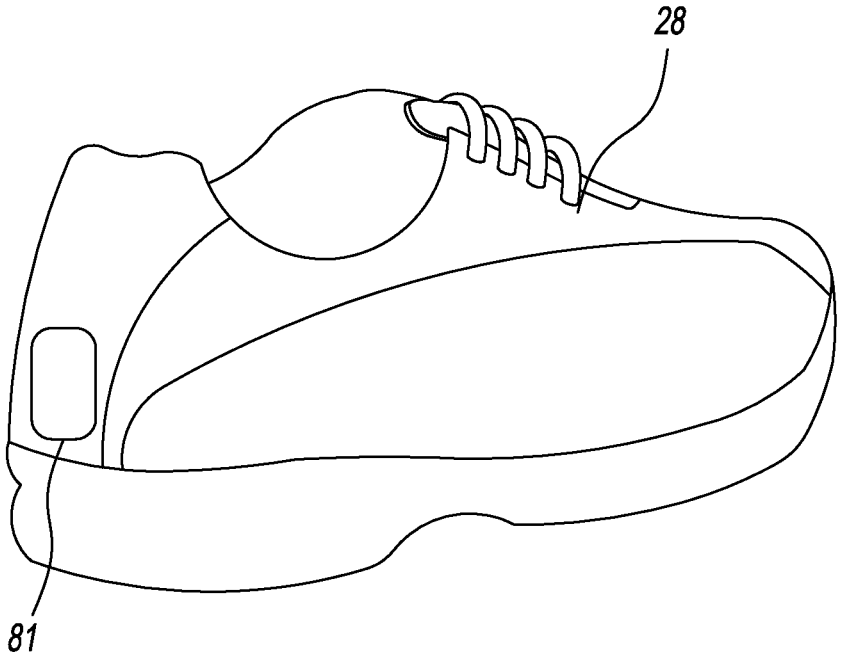
FIG. 8 is an alternate embodiment of the device of FIG. 1.
Figure 9:
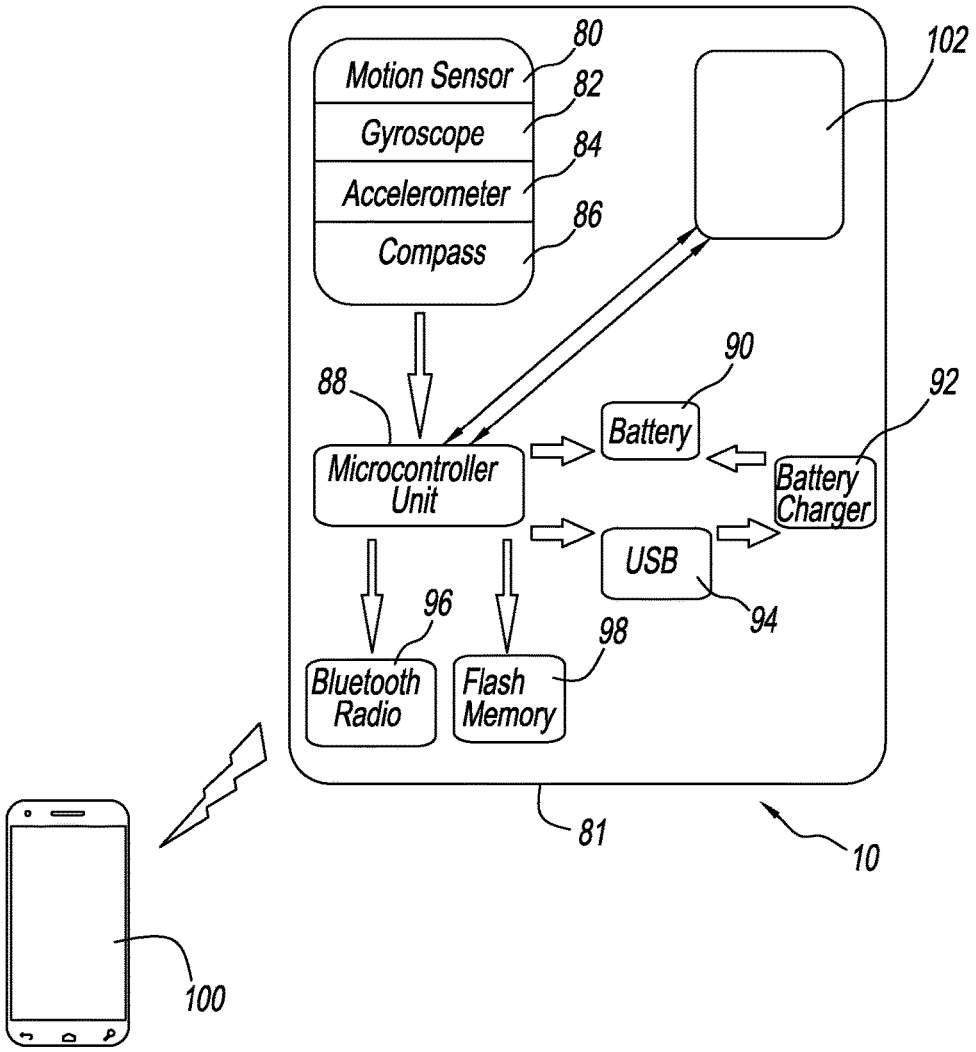
FIG. 9 is an internal structure of the device of FIG. 8.

Although device 10 has been described as an analog device, device 10 can also be digital or electronic. For example, FIGS. 8 and 9 show device 10 as an electronic sensor 81 that is affixed to, or contained within the heel portion of shoe 28. Sensor 81 can include a motion sensor 80, a gyroscope 82, an accelerometer 84, a compass 86, or combinations thereof Motion sensor 80, a gyroscope 82, an accelerometer 84, a compass 86 are communicatively coupled to a microcontroller unit 88 for controlling and communicating with the same, as well as storing data collected therefrom in a non-transitory memory 98.

Also communicatively coupled to microcontroller unit 88 is a wireless radio 96, such as Bluetooth, WiFi for communicating with an external user device any data logged by sensor 81 and stored in memory 98. Sensor 81 further includes a USB, serial, or other port for either charging, transferring data to an external user device, or both. Sensor 81 is powered by a battery which is communicatively coupled to a charging circuit. A USB or similar connector is coupled to the charging circuit. Although illustrated as having a rechargeable battery, sensor 81 can also be powered by disposable batteries. An indicator 102 alerts a user if a swing or throw followed proper form. Indicator 102 can be a speaker producing an audible alert or a light, producing a visual alert, or both.

User device 100 can be a smart phone, laptop, smart watch, desktop computer, and any similar devices that can provide a user interface so that the user can interact with data generated by sensor 81.

Advantageously, a user can transfer data from flash memory 98 to user device 100 via wireless radio 96 and later analyze their swinging and/or throwing performance.

Sensor 81 detects the same path as device 10 through motion sensor 80, gyroscope 82, and/or accelerometer 84.

Figure 10:
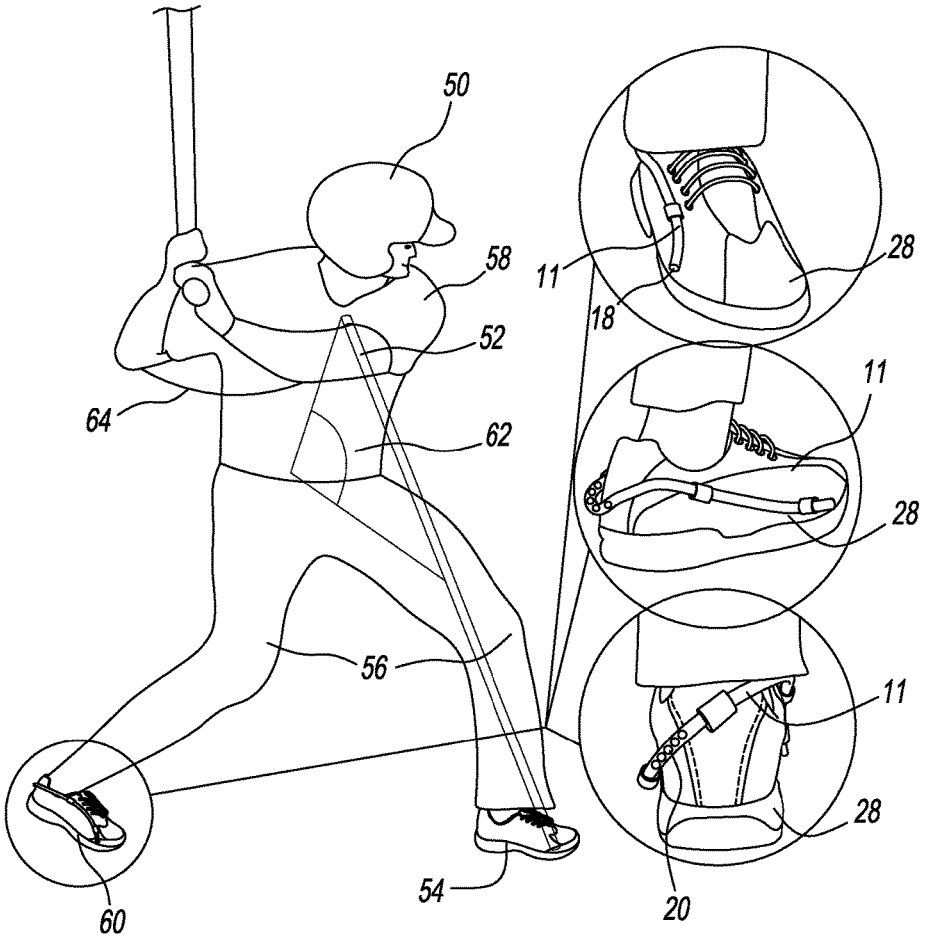
FIG. 10 is a view of a sequence of motions where the device of FIG. 1 indicates a proper swing.
Figure 11:
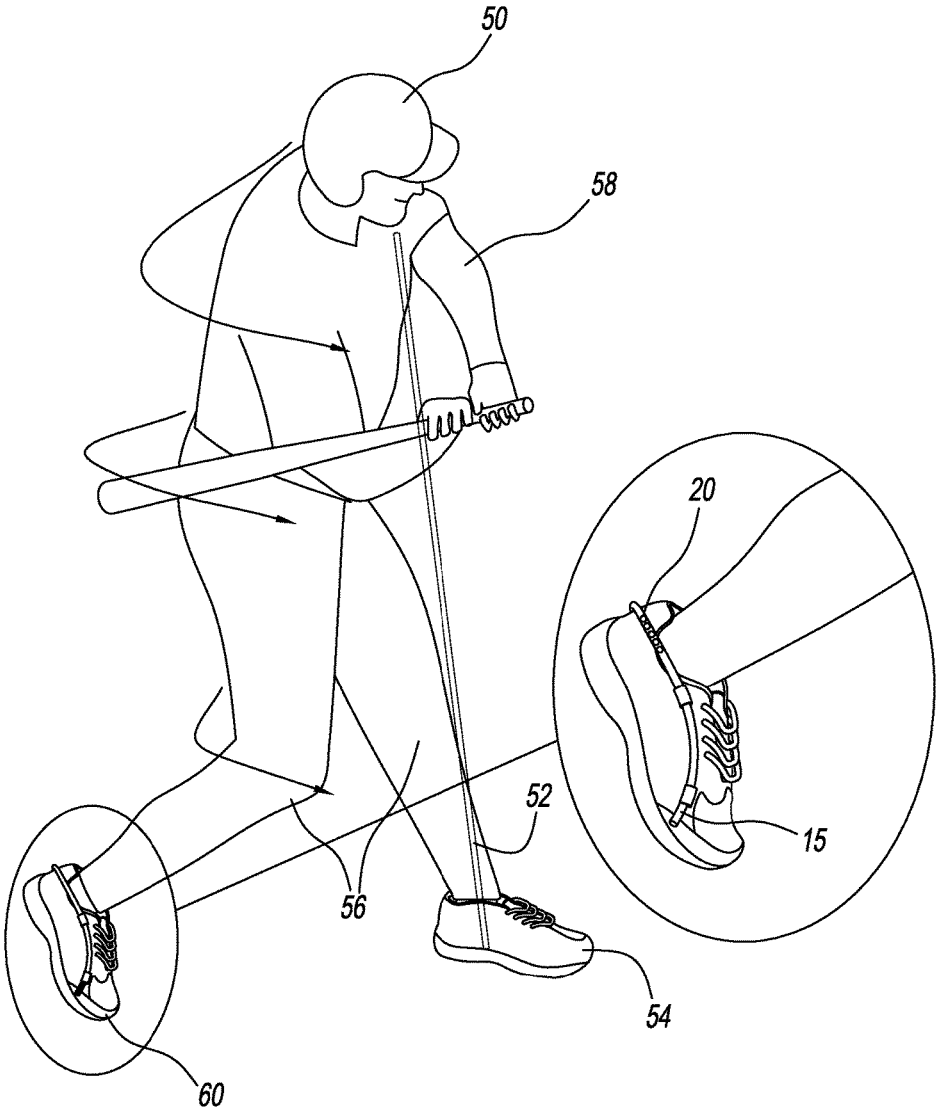
FIG. 11 is a view of a sequence of motions where the device of FIG. 1 indicates a proper swing.
Figure 12:
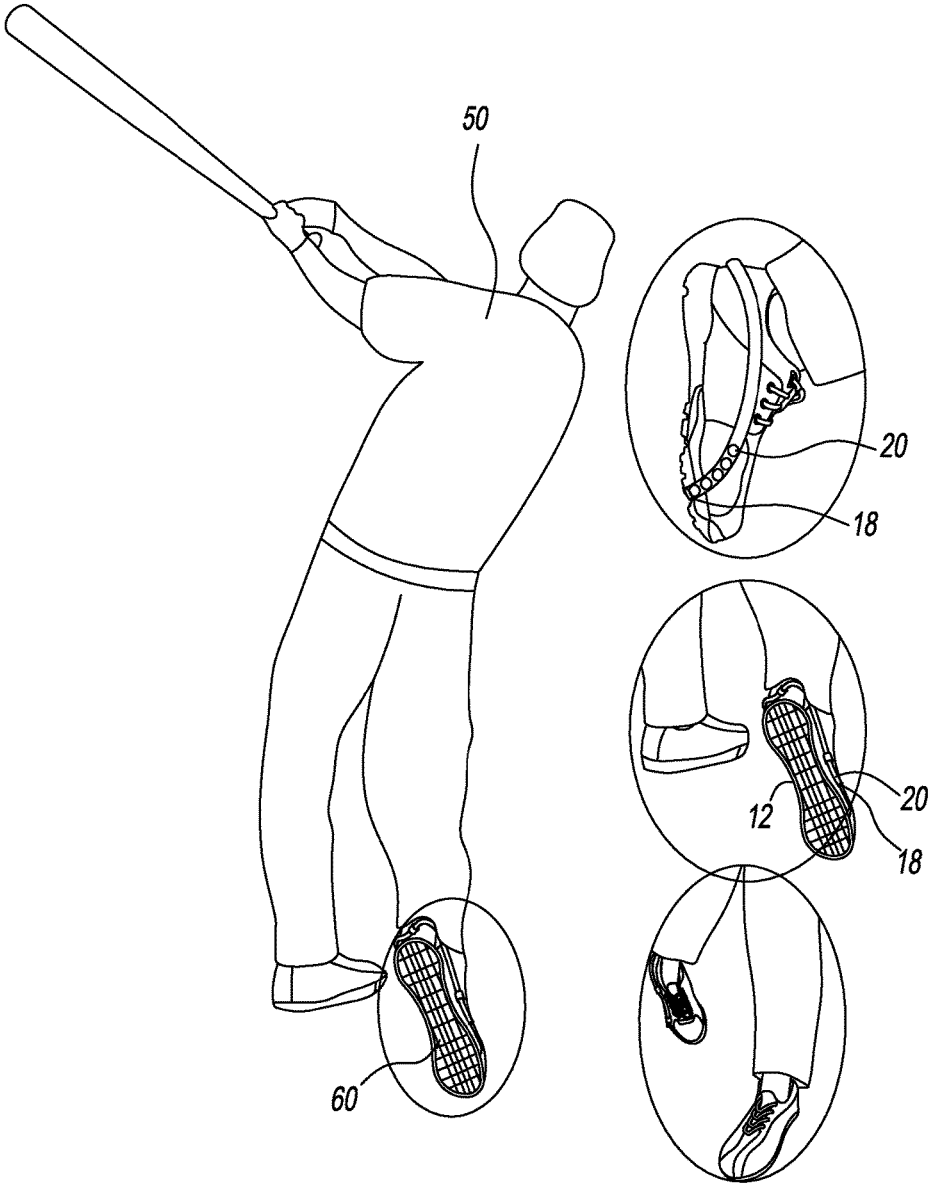
FIG. 12 is a view of a sequence of motions where the device of FIG. 1 indicates a proper swing.

FIGS. 10, 11 and 12 illustrate device 10 being used by a user 50 executing proper body motions and form in sequence, and accordingly indicating the same because indicator 20 has moved from proximal end 12 to distal end 18.

Surprisingly, it has been found that by detecting motion in a user's rear foot, device 10 further indicates that the foot pushes off to shift weight to the axis of rotation, and rotates. The foot rotation acts as a crank with the back leg to initiate the hip rotation. The hips rotate in a circular motion and transfer rotational energy to the shoulders. The shoulders rotate in a circular motion at two times the rotation of the hips due to gearing gain. Shoulders, arms, and wrists pronate naturally and coincident with the shoulder rotation, and complete their pronation at the halfway point of the body's rotation.

Device 10 will also indicate when a user has not executed proper form and technique during a swing or throw, as indicator 20 will not move as described above during an improper swing. Examples include but are not limited to: swinging or throwing with all arms, swinging or throwing with elbows bent and disconnected, sliding with hips, swing or throwing with weight on back foot, and standing too straight with no flex when swinging or throwing.

When user 50 swings and follows through properly centripetal and gravitational forces will move the indicator 20 from proximal end 12 to distal end 18, providing instant visual and/or auditory feedback that the swing or throw was correct. The act of executing this motion properly such that the indicator 20 travels from proximal end 12 to distal end 18 will urge user 50 to maintain a correct weight balance, maintain a correct posture, maintain the proper angles or joint bends, ensure appropriate muscles flex, keep various body parts properly aligned, generate rotational forces around a stable axis, and ultimately ensure the sequence of movement in the swing or throw flows correctly and naturally.

User 50 must push off his rear foot from a position flat on the ground (push off start position 40) all the way to vertical at the end of his follow-through while keeping the inside of his front foot anchored firmly to the ground. This creates an imaginary axis of rotation 52 extending from the inside of the front foot 54 through the flexed knees 56 and ending at the front shoulder 58. As the back foot 60 rotates up and through, it acts as a crank that forces the hips, shoulders, and arms of user 50 to rotate through to contact and finish. In order for user 50 to push off the back foot 60 and follow through until the back foot 60 rotates forward to a vertical position (push off end position 42) with toes touching the ground, user 50 has to maintain weight balance, body angles (ie. magic triangle 62, as known in the art), muscle flex in the legs, connectivity between the elbows 64, rotation, and sequence.

Figure 13:
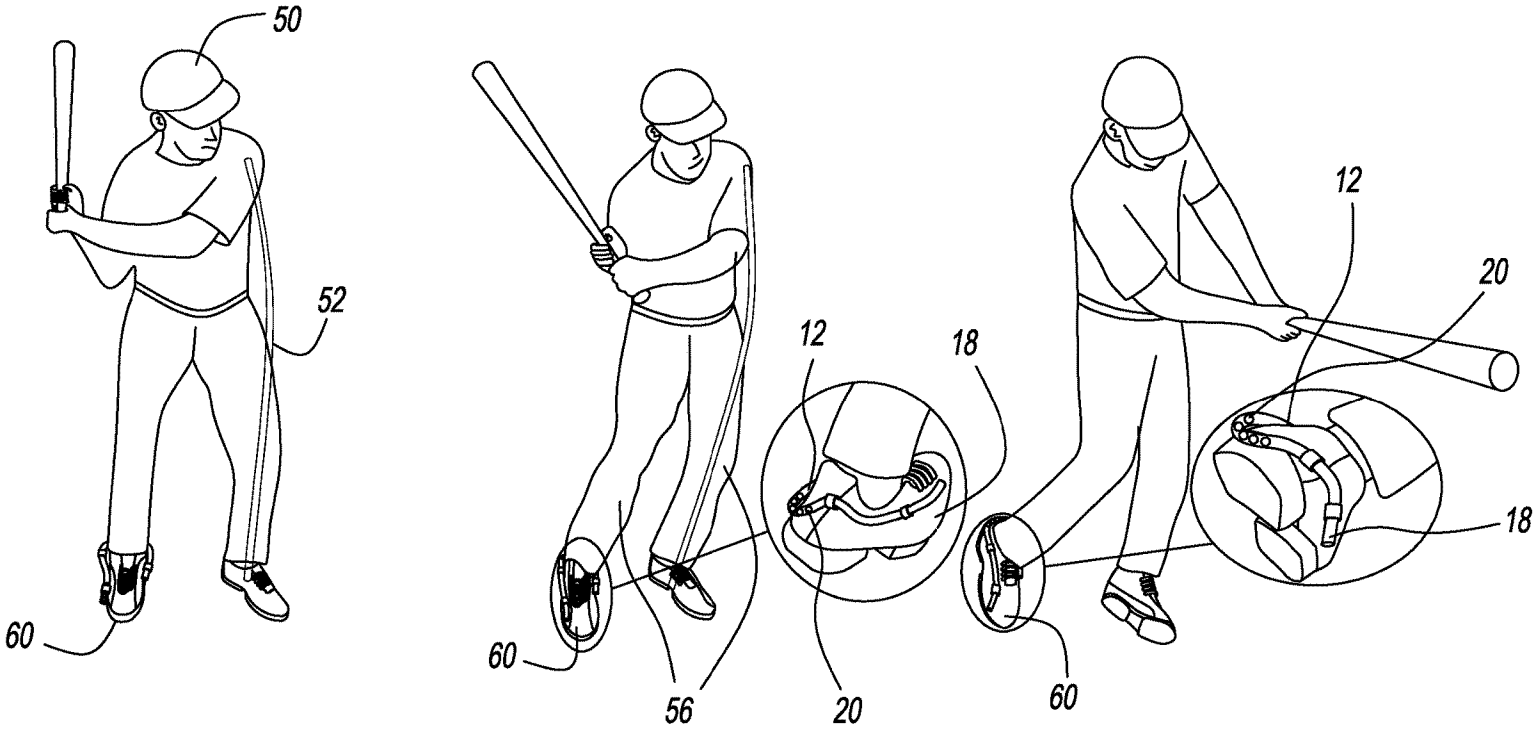
FIG. 13 is a view of sequences where the device of FIG. 1 indicates an improper swing.
Figure 16:
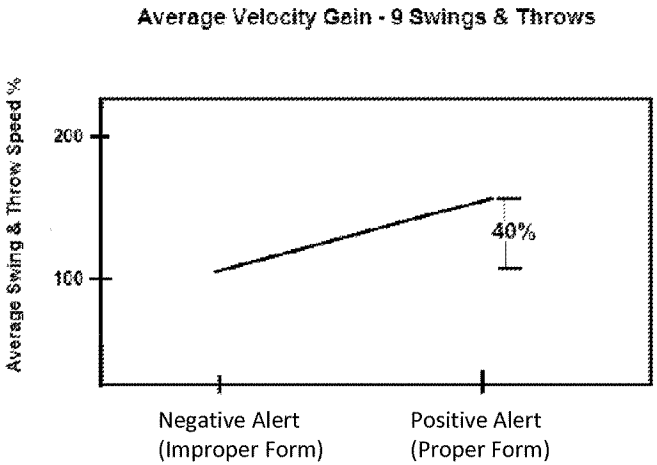
FIG. 16 is a chart comparing velocity gain of a positive and negative alert from the device of FIG. 1.
Figure 17:
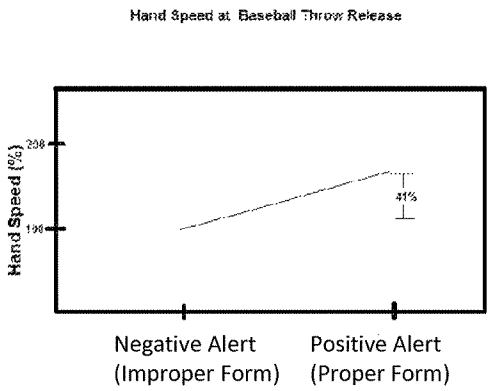
FIG. 17 is a chart comparing velocity gain of a positive and negative alert from the device of FIG. 1.
Figure 14:
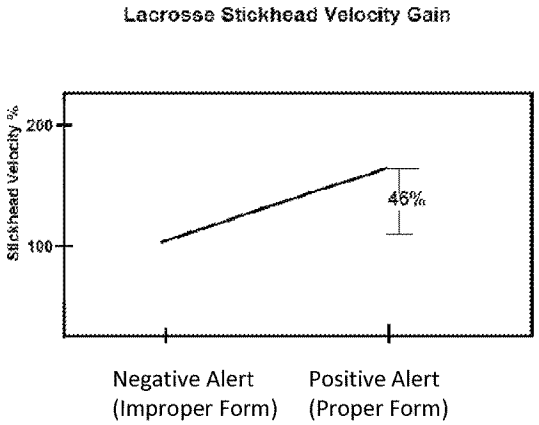
FIG. 14 is a chart comparing velocity gain of a positive and negative alert from the device of FIG. 1.
Figure 15:
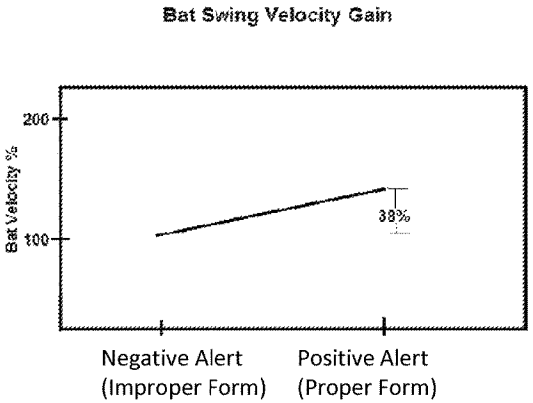
FIG. 15 is a chart comparing velocity gain of a positive and negative alert from the device of FIG. 1.
Figure 18:
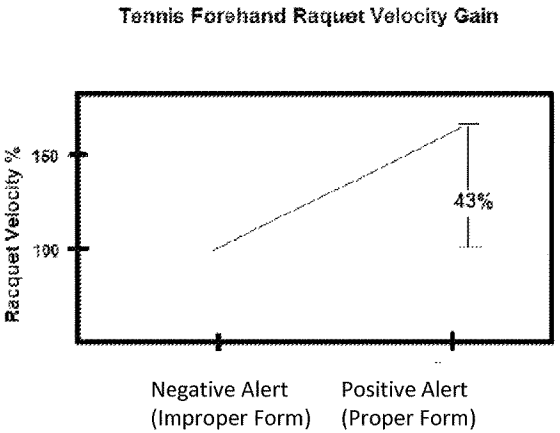
FIG. 18 is a chart comparing velocity gain of a positive and negative alert from the device of FIG. 1.
Figure 20:
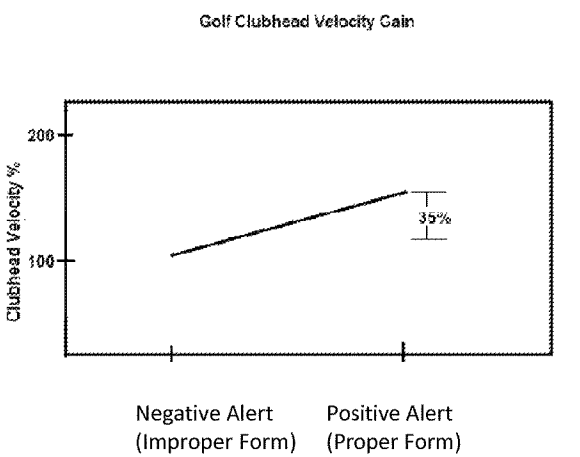
FIG. 20 is a chart comparing velocity gain of a positive and negative alert from the device of FIG. 1.
Figure 21:
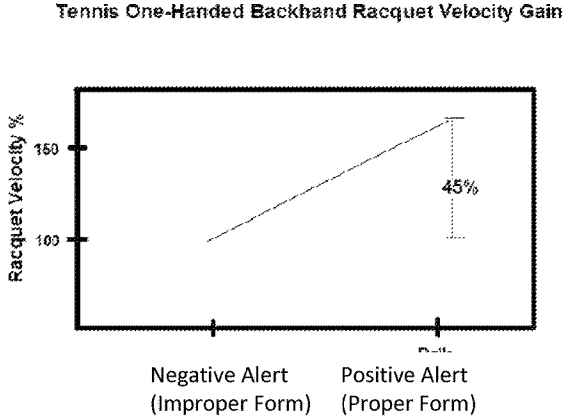
FIG. 21 is a chart comparing velocity gain of a positive and negative alert from the device of FIG. 1.
Figure 19:
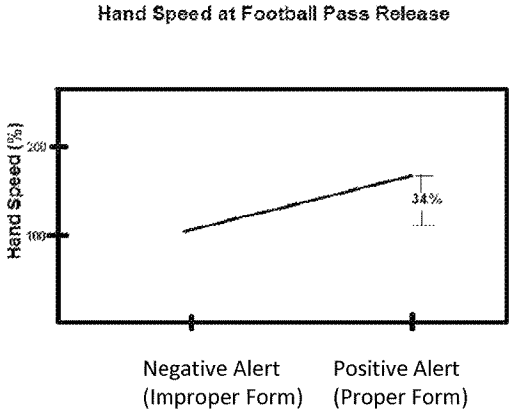
FIG. 19 is a chart comparing velocity gain of a positive and negative alert from the device of FIG. 1.
Figure 22:
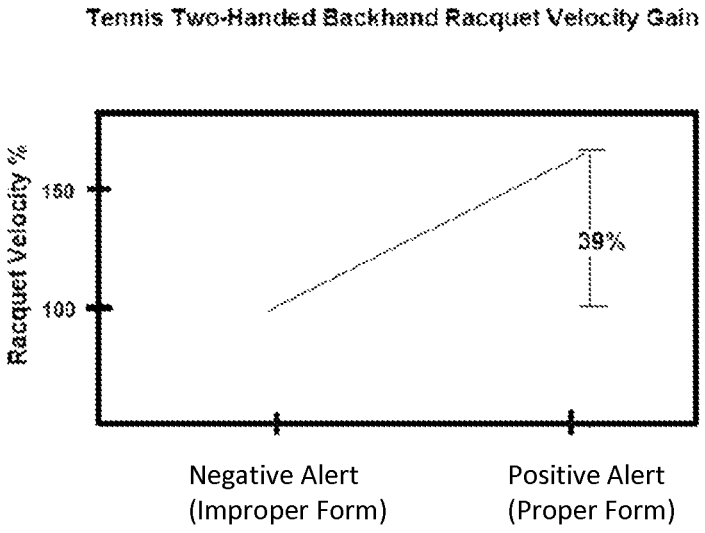
FIG. 22 is a chart comparing velocity gain of a positive and negative alert from the device of FIG. 1.
Figure 23:
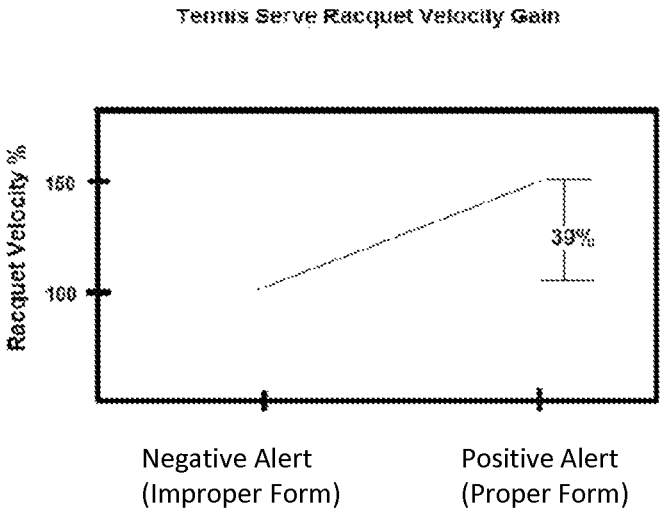
FIG. 23 is a chart comparing velocity gain of a positive and negative alert from the device of FIG. 1.

FIG. 13 illustrates device 10 being used by a user 50 not executing proper body motions and form in sequence because indicator 20 has failed to move from proximal end 12 to distal end 18.

In FIG. 13, user 50 has axis of rotation 52 bent, limited push off of back foot 60, knees 56 are not flexed properly and slide past the foot, and there is limited hip and shoulder rotation. Accordingly, indicator 20 does not move from proximal end 12 to distal end 18, thus indicating to user 50 that the swinging and body motions were not proper.

The heel velocity required for indicating a proper swing or throw will change with shoe size. For a 12 inch shoe (approximately a size 11 US), the velocity of the balls is preferably between about 5.9 to 8.9 ft/sec (4-6 mph), and most preferably about 7.4 ft/sec (5 mph).

Thus, for a six inch shoe, the velocity will be half of the speed, since the radius of the guide or path will be half and the guide or path distance will be ¼ of a 360 degree path. For a 6 inch shoe this would correspond to about 3.7 ft/sec+/−20%. Generally, the velocity is given by the formula:

$$\text{Velocity} = \frac{1}{2} \times \pi \times \frac{\text{radius}}{\text{time}}$$

When the shoe follows the correct path and reaches the necessary velocity, the indicator 20 will move from proximal end 12 and continue over the high point of the curve in heel section 14 to distal end 18.

The movement of the push off foot, from start position to end position, should take about ⅕ of a second +/−25% (0.15-0.25 seconds), or more preferably +/−20% (0.16-0.24 seconds), or most preferably +/−15% (0.17-0.23 seconds). This corresponds to the time it takes for the indicator to traverse the entire guide or path.

Typical shoe sizes are between 6 inches and 12 inches. It is contemplated that the device will work with shoes as small and large as 3.5 inches small and 15 inches large Although illustrated as a baseball swing in FIGS. 9, 10, 11, and 12, the same principles apply to a baseball throw. Likewise, the same principles and mode of operation apply to other sports as previously described.

Advantageously, when indicator 20 is a plurality of spheres, device 10 can alert a user that the swing or throwing motion is not proper, but is close. In this case, some of the plurality of spheres would move from proximal end 12 to distal end 18, and some would not.

Device 10 can be adapted to either a left or a right shoe.

Although illustrated herein with a shoe, it is contemplated that device 10 can attach to other footwear such as socks, skates, boots, and the like. Device 10 can also attach directly to a user's bare foot.

Although illustrated herein with three attachment points 22, 24, and 26, it is contemplated that there could instead be one, two, or more attachment points. Alternatively, the device can be integrated in the footwear.

FIGS. 14-23 show the velocity gains that resulted from a positive alert (i.e., proper form) compared to a negative alert (i.e., improper form). Testing was done with three adult subjects and three child subjects, each having varying degrees of skill. Each subject performed 25 swings or throws for each sport.

For swings, a radar device was positioned adjacent to the point of contact between the swinging apparatus and ball. For throws, a radar device was positioned adjacent to the point of release of the ball. Data was recorded for each throw and swing, but when a subject failed to trigger one positive alert for a particular swing or throw, all data for that motion was discarded.

Velocity gains were averaged to ensure that skill levels didn't influence the data. On Average, a user was able to see about a 40% increase in velocity when using proper form as indicated by device 10. A Lacrosse stick-head showed a 46% increase, a bat swing showed a 38% increase, a baseball throw hand speed showed a 41% increase, a tennis forehand racquet showed a 43% velocity gain, a golf club head showed a 35% velocity gain, a football hand throw showed a 34% velocity increase, a one handed backhand tennis racquet swing showed a 45% velocity gain, a two handed backhand tennis racquet swing showed a 39% velocity gain, and a tennis serve showed a 39% velocity increase.

Further, any provided numerical ranges, unless otherwise expressly stated, include any and all subordinate ranges that are between the provided numerical ranges.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A device comprising:

an arcuate guide disposed about a shoe, the guide having a start point on an inner side of the shoe, an intermediate point on a heel side of the shoe, and an end point on an outer side of the shoe, wherein the guide is angled upward across the heel side from the inner side to the outer side in a range between 30 degrees to 60 degrees, wherein the start point and end point are positioned on the shoe at points lower than the intermediate point; and an indicator moveable along the guide, wherein the indicator is an alert that, during a swing or throw, a user has pushed off with a rear foot from a flat position on a surface, kept an inside of a front foot anchored to the surface, and shifted the rear foot to a vertical position once the swing or throw is completed when the indicator traverses from the start point through the intermediate point to the end point.

2. The device of claim 1, wherein the indicator is at least a first metal sphere.

3. The device of claim 1, wherein the guide is a tubular member, and wherein the tubular member houses the indicator.

4. The device of claim 1 further comprising:

a shoe attachment connecting the guide to the shoe.

5. The device of claim 4, wherein the shoe attachment is one selected from the group consisting of: hook-and-loop strips, magnets, and adhesives.

6. The device of claim 1, wherein the guide is angled upward across the heel side from the inner side to the outer side at 40 degrees to 50 degrees.

7. An assembly comprising:

a shoe having an inner side, a heel side, and an outer side;

an arcuate guide, disposed about the shoe, the guide having a start point on the inner side of the shoe, an intermediate point on the heel side of the shoe, and an end point on the outer side of the shoe, wherein the guide is angled upward across the heel side from the inner side to the outer side in a range between 30 degrees to 60 degrees, wherein the start point and end point are positioned lower on the shoe than the intermediate point; and an indicator moveable along the guide, wherein the indicator is an alert that, during a swing or throw, a user has pushed off with a rear foot from a flat position on a surface, kept an inside of a front foot anchored to the surface, and shifted the rear foot to a vertical position once the swing or throw is completed when the indicator traverses from the start point through the intermediate point to the end point.

* * * * *